United States Patent [19]

Taylor

[11] 3,935,408

[45] Jan. 27, 1976

[54] HEATING MEANS FOR HIGH-VOLTAGE GAS-TYPE CIRCUIT INTERRUPTER

[75] Inventor: Maurice J. Taylor, Dedham, Mass.

[73] Assignee: Westinghouse Electric Corporation, Pittsburgh, Pa.

[22] Filed: Dec. 21, 1973

[21] Appl. No.: 427,278

[52] U.S. Cl. ..... 200/148 B; 200/148 R; 200/148 E

[51] Int. Cl.[2] ..... H01H 33/57

[58] Field of Search ..... 200/148 B, 148 G, 148 R, 200/148 A, 148 F

[56] References Cited

UNITED STATES PATENTS

| | | | |
|---|---|---|---|
| 3,358,104 | 12/1967 | Cromer | 219/209 |
| 3,566,062 | 2/1971 | Meier et al. | 200/148 |
| 3,814,879 | 6/1974 | Cookson et al. | 200/148 R |

OTHER PUBLICATIONS

R. E. Kane, Z. Neri, IEEE Transactions, Mar/Apr 71, pp. 647–651.

*Primary Examiner*—Robert S. Macon
*Attorney, Agent, or Firm*—W. R. Crout

[57] ABSTRACT

An improved heating means is provided for heating the gas in a high-voltage gas-type circuit-interrupter of the type utilizing an arc-extinguishing gas, which may be subject to the disadvantage of liquefaction during relatively moderate temperatures. The construction is such that primary and secondary heating means are associated with a convection chamber, the primary heating means being responsive to a probe monitoring the actual gas temperature provided within the convection chamber and maintains the gas temperature within the convection chamber to a predetermined temperature.

Preferably, a secondary heating bank is additionally provided, assuming the form, for example, of one or more separate heater elements, which are turned on and off by the external atmospheric ambient temperature.

For certain applications, the convection chamber is tilted, or slanted with respect to the arc-extinguishing assemblage, the latter extending upwardly at an angle with respect to the lower-disposed heating chamber. Thus, by the provision of a plurality of holes provided in the heating chamber, gas is encouraged to flow up the high physical side of the upstanding casing assemblage; and the cooler gas is returned down along the lower physical side of the casing assemblage for encouraging a convection flow.

Additionally, a plurality of circularly-arranged fins may be provided, affixed to the bottom of the heating chamber, for providing a greater heat surface area to the gas, and in accordance with the aforesaid convection principle, the heating fins may be disposed only at the upper physical side of the heating chamber.

23 Claims, 19 Drawing Figures

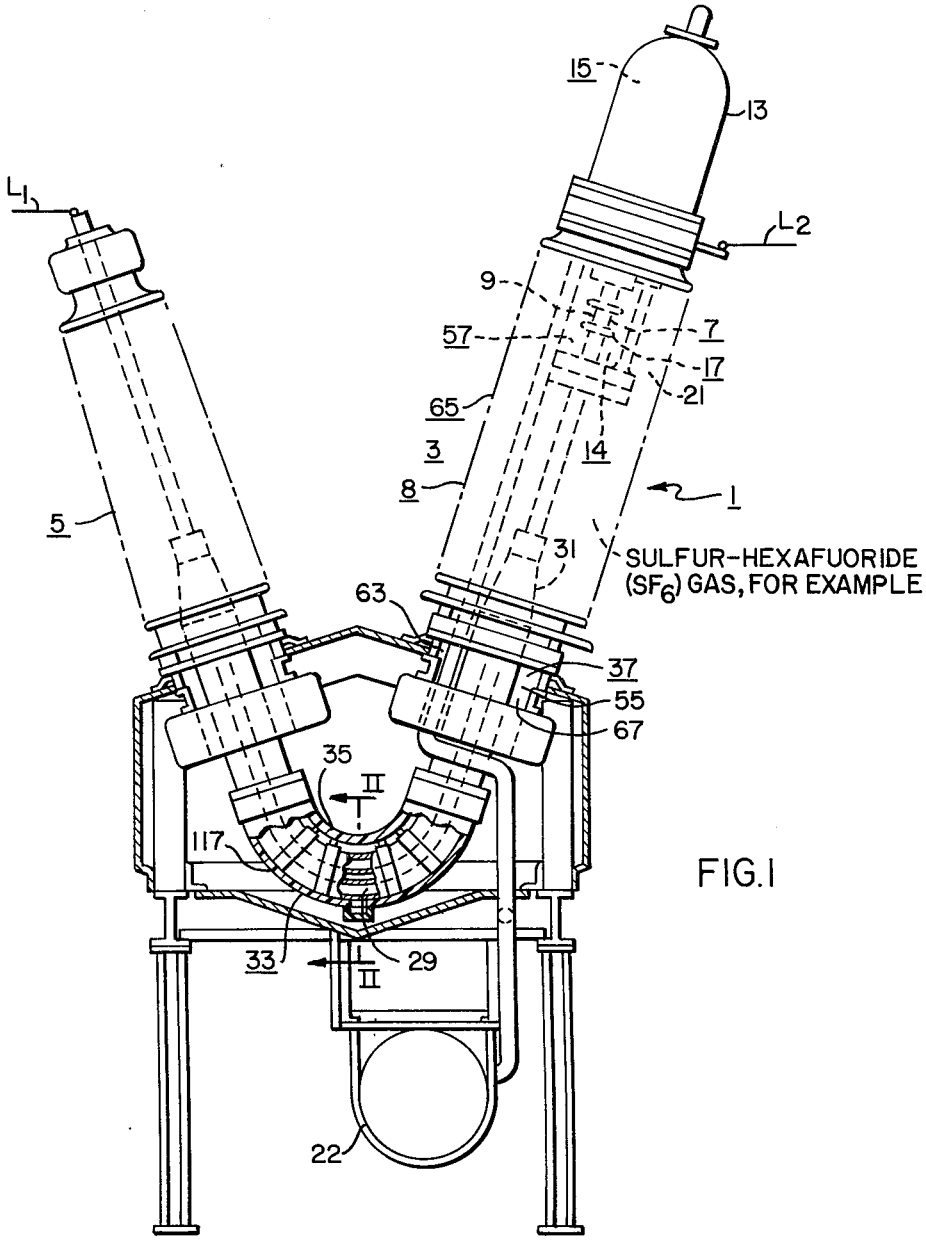
FIG.1
FIG.2
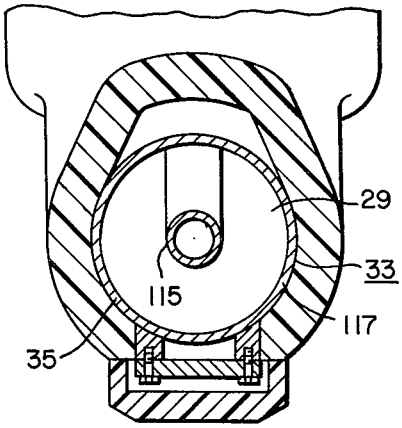
FIG.3
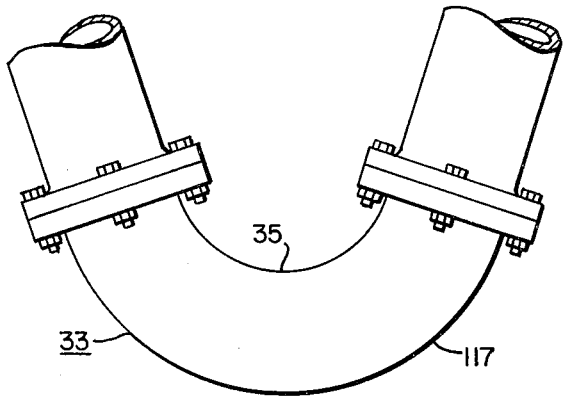

HEATING MEANS FOR HIGH-VOLTAGE GAS-TYPE CIRCUIT INTERRUPTER

CROSS-REFERENCE TO RELATED APPLICATIONS

In U.S. patent application filed Sept. 13, 1972, Ser. No. 288,843, now U.S. Pat. No. 3,852,550, issued Dec. 3, 1974 to Bertolino et al., and assigned to the assignee of the instant application, there is illustrated and described an improved circuit-breaker construction in which an insulating sleeve-like partition member is provided around the high-voltage conductor tube within the high-pressure storage chamber. Small filter elements are provided in the high-voltage conductor tube to equalize the pressure conditions on the inside and the outside of the aforesaid sleeve-like insulating member, yet to prevent the entrance of insulating or metallic particles into the annular region surrounding the high-voltage conductor tube and constituting a high-pressure chamber.

Also, U.S. patent application filed Mar. 9, 1971, Ser. No. 122,453, now U.S. Pat. No. 3,814,879, issued June 4, 1974 to Cookson et al., and assigned to the assignee of the instant application, illustrates the theoretical background for the problem encountered when insulating, or metallic particles enter a high-pressure region, and tend to precipitate high-voltage breakdown between members at widely-different voltage levels.

Reference may additionally be made to U.S. patent application filed Dec. 21, 1973, Ser. No. 427,279 by M. J. Taylor, et al., and assigned to the assignee of the instant application, for a description of a particle-collection chamber, which may be additionally used as the heating chamber referred to in the instant patent application.

BACKGROUND OF THE INVENTION

In the aforesaid U.S. Pat. No. 3,814,879 there is illustrated and described various means for preventing relatively small particles entering into regions of high electrical field stress. Also, the aforesaid U.S. Pat. No. 3,852,550 sets forth the problem, which is encountered in high-voltage compressed-gas circuit-interrupters, where an effort is made to prevent relatively small insulating or metallic particles entering into the high-pressure gas-storage regions, where electrodes are present at widely-different voltage levels from each other, for example, approaching 200 K.V. in magnitude.

Since the opening and closing circuit breaker operations with heavy impact forces involved, of the metallic separable contacts tend to generate small metallic particles, which thereby tend to roam about in the gaseous region, it is necessary to prevent these small metallic or insulating particles from entering into the high-pressure gas-storage regions, where the conducting high-voltage parts are closely spaced together, and where, obviously, high electrostatic fields are generated between such close-spaced high-voltage metallic members. It has been proven by test that small particles, either insulating or conducting, will tend to precipitate a voltage breakdown between such high-voltage members, which are at widely-different voltage levels.

In U.S. patent application filed July 7, 1972, Ser. No. 269,691, now U.S. Pat. No. 3,792,218, issued Feb. 12, 1974 to Cromer et al., and assigned to the assignee of the instant application, there is illustrated a perforated support cone in FIG. 1 of said patent application, which permits free communication between the high-pressure gas within the interrupting area and the high-pressure region within the lower U-shaped high-pressure gas storage chamber, and electrical heaters, designated by the reference numeral 75 in said U.S. Pat. No. 3,792,218, heat the gas to prevent liquefaction of the gas; and the thus heated gas freely enters upwardly past the high-pressure region, and through the perforated support cone and into the contact interrupting region. The hazard results that small metallic particles will enter the perforated cone, as set forth in FIG. 1 of said patent application, and drop downwardly into the lower high-pressure U-shaped gas storage region, so as to create the hazard in the U-shaped high-pressure gas storage region of possible breakdown or flashover therein.

Also, reference may be made to U.S. Pat. No. 3,596,028 issued July 27, 1971 to Kane et al., and assigned to the assignee of the instant application, for a description of the general type of interrupting structure, also utilizing a perforated support cone, and which is subject to the same problem.

SUMMARY OF THE INVENTION

According to the present invention, there is provided an improved heating arrangement for heating the gas within a high-voltage high-power gas-type circuit-interrupter, in which an annularly-arranged heating chamber is provided around the high-voltage conductor, and heating means is associated with said chamber to heat the gas provided therein.

In accordance with another feature of the present invention, there is provided a primary heating means responsive, as by means of a probe, or the like, monitoring the temperature within the heating chamber, to maintain the heating of the gas within the heating chamber at a predetermined value. Additionally, if desired, a secondary bank of heaters may be provided, associated with said heating chamber, and being responsive to the temperature of the external atmospheric ambient temperature surrounding the circuit-breaker installation.

The primary and secondary heating banks thus prevent the liquefaction of the arc-extinguishing gas.

In addition, and preferably desired, although not absolutely necessary, a plurality of heating fins may be utilized to provide greater heat surface area to the gas within the heating chamber, and, preferably, said heating fins are disposed at an upper physical relationship with the heating chamber, for example, the latter being tilted, or slanted, so that greater heating surface area is provided at the high physical side of the heating chamber, and gas will thus pass upwardly by convection flow interiorly within the upstanding arc-extinguishing assemblage and return along the lower physical side of the heating chamber.

Further objects and advantages will readily become apparent upon reading the following specification, taken in conjunction with the drawings.

BRIEF DESCRIPTION OF THE DRAWINGS

FIG. 1 is an end elevational view, partially in section, of an improved high-voltage gas-type circuit-interrupter embodying the principles of the present invention, the contacts being shown closed;

FIG. 2 is an enlarged sectional view taken substantially along the line II—II of FIG. 1 looking in the direction of the arrows;

FIG. 3 is a fragmentary side elevational view of the lower high-pressure gas U-bend member provided in the circuit-interrupter of FIG. 1 to store high-pressure gas therein;

DESCRIPTION OF THE PREFERRED EMBODIMENTS

Figure 18:
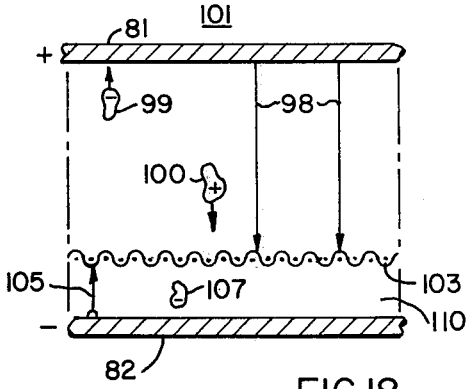
FIG.18 PRIOR ART

Referring to the drawings, and more particularly to FIGS. 1–4 thereof, it will be observed that there is provided a high-voltage gas-type circuit-interrupter, designated by the reference numeral 1, and for the lower-voltage ratings, utilizing a single arc-extinguishing assemblage 3 on one side of the structure, and a terminal-bushing structure 5 on the other side of the structure, as shown in FIG. 1. However, for the higher-voltage and current ratings, two such arc-extinguishing assemblages 3, may be provided on both sides of the circuit-breaker structure 1, and one of these arc-extinguishing assemblages 3, will, of course, take the place of the left-hand terminal-bushing structure 5, as actually illustrated in FIG. 1, which shows a lower voltage and current rating breaker. Reference may be directed to FIGS. 18–20 of U.S. Pat. No. 3,596,028 for the concept of utilizing a plurality of arc-extinguishing assemblages 3 for the higher ratings, or only one arc-extinguishing assemblages 3, taken in conjunction with a terminal-bushing structure 5, as set forth in FIGS. 18–20 of U.S. Pat. No. 3,596,028 issued to Kane et al., and assigned to the assignee of the instant application.

Figure 4:
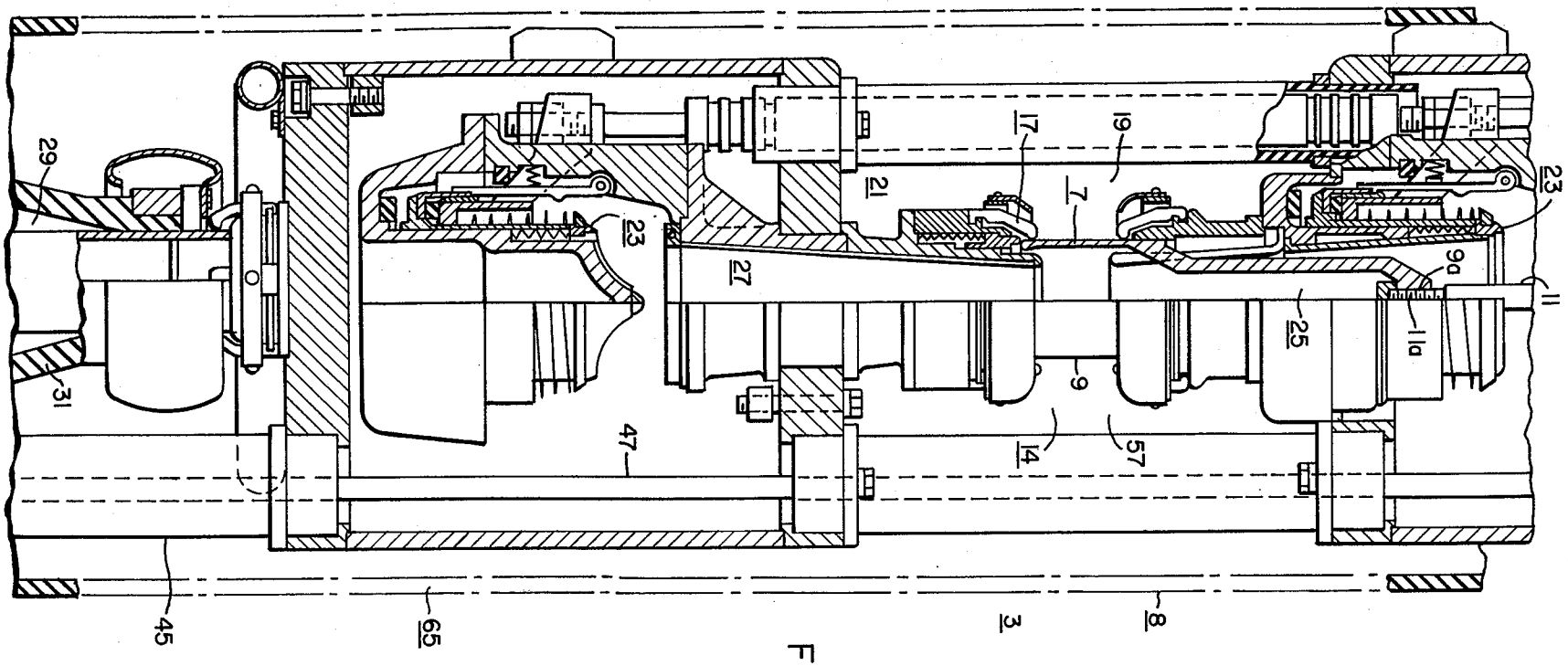
FIG. 4 is an enlarged fragmentary sectional view illustrating the general type of contact interrupting structure provided in the circuit-interrupter of FIG. 1, and illustrating the top portion of the unperforated support member or cone, the contact structure again being illustrated in the closed-circuit position.

With attention being directed to FIG. 4, it will be observed that there is provided a separable contact structure 7 having a moving contact 9, which is attached, at its upper end, as at 9*a*, to the lower threaded end 11*a* of an upper operating rod 11, the latter projecting upwardly into a dome portion 13 of the arc-extinguishing assemblage 3 (FIG. 1), wherein a suitable high-voltage operating mechanism 15, such as a piston-and-cylinder arrangement, may be provided to effect upward opening motion of the movable contact 9, or downward closing motion of the same. Reference may be made to U.S. Pat. No. 3,590,189 issued June 29, 1971 to Fischer et al. for a detailed description of the high-voltage operator 15, which is disposed interiorly within the upper dome portion 13 of the extinguishing assemblage 3. Also, if desired, reference may be made to U.S. Pat. No. 3,596,028 issued to Kane and Reese, and assigned to the assignee of the instant application, for a detailed description of the operation of the circuit-interrupter 1, and the method of controlling gas-flow during extinction of the arc (not shown) established between the moving main contact 9 and the stationary main contact structure 17 of FIG. 4 of the drawings.

In order to understand the present invention, however, it is only necessary to know that high-pressure gas 19, for example, sulfur-hexafluoride ($SF_6$) gas, say at 260 p.s.i., exists in the region 21 exteriorly of the separable main contact structure 7, and is available at all times at high pressure to effect arc extinction when the moving main contact 9 is moved upwardly by the aforesaid operator 15 away from the lower main stationary contact structure 17 of FIG. 4.

To halt the upward and downward exhausting gas-flow through the hollow movable contact 9 and the hollow stationary contact 17, suitable secondary blast-valve structure 23 is provided, which is latched and governed so as to close following extinction of the arcing (not shown). Thus, in the open-circuit position of the interrupter 1, not shown, high-pressure gas 19 exists not only in the region 21 but also in the regions interiorly of both movable and stationary contact structures 9, 17, as at 25 and 27 in FIG. 4.

Reference may be had to U.S. Pat. No. 3,665,133 by Reese et al., and assigned to the assignee of the instant application, for a description of the operation of the main separable contact structure 7 illustrated in FIG. 4 of the instant drawings, and the teachings in said U.S. Pat. No. 3,665,133 are incorporated herein by reference. The high-voltage operator 15, referred to hereinbefore, is set forth in FIG. 2 of said patent application, and the operation of the separable contact structure 7 is set forth in FIGS. 3, 5, 6 and 7 of said patent application.

As stated hereinbefore, the prior art, as exemplified by the aforesaid U.S. Pat. No. 3,596,028, shows in FIG. 5A a perforated support cone (unnumbered), which permits the roaming of small particles downwardly into the U-bend gas storage structure, designated by the reference numeral 71 in FIG. 5B of the drawings of U.S. Pat. No. 3,596,028. This is undesirable for small particles may precipitate high-voltage breakdown in even a high-pressure chamber 117, where the conducting members 29, 71 of said U.S. Pat. No. 3,596,028 are spaced closely together. A possible remedy for the aforesaid situation is set forth in U.S. Pat. No. 3,852,550.

Figure 12:
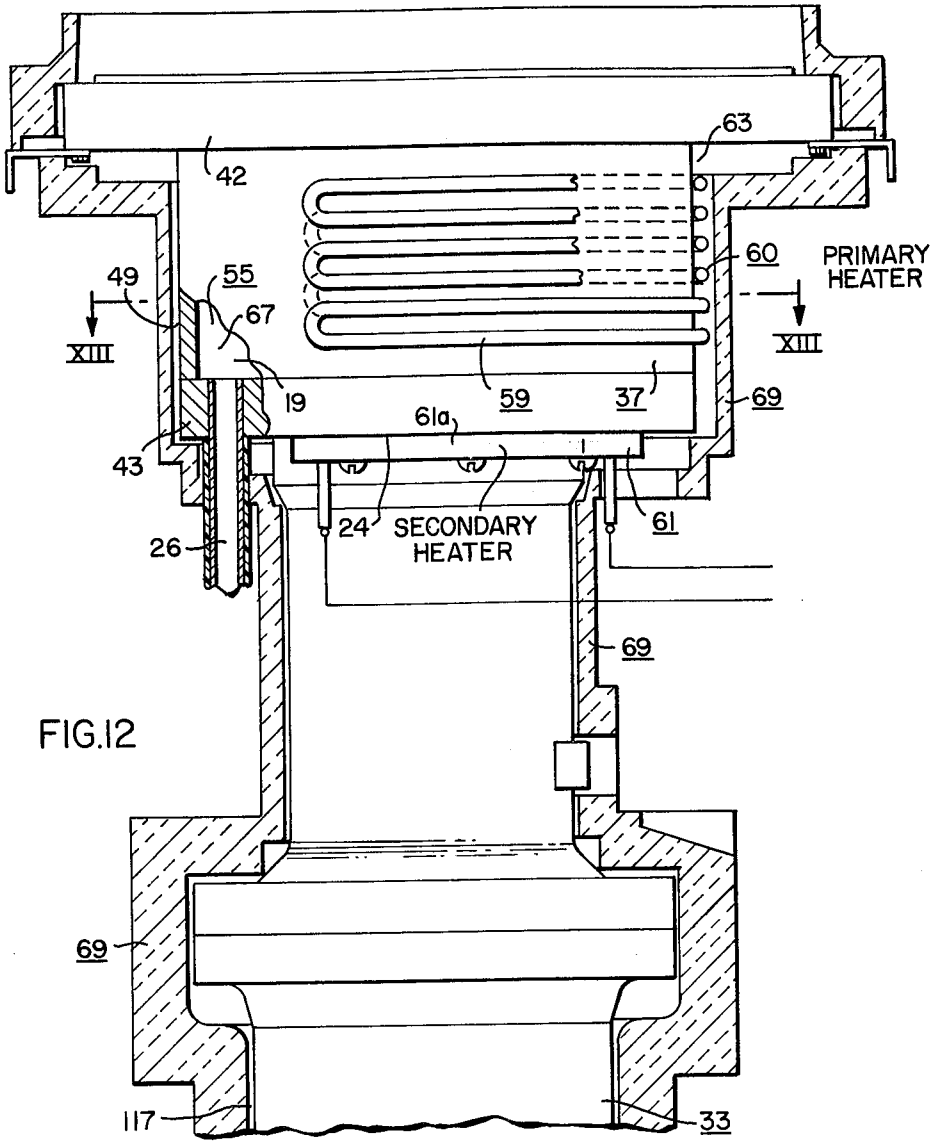
FIG. 12 illustrates the collecting chamber and the upper portion of the U-bend having insulation material disposed thereabout, and showing the location of the primary and secondary heating strips.

Since it remains necessary to heat the sulfur-hexafluoride ($SF_6$) gas 19 within the region 21 interiorly of the column structure 8 (FIG. 1), and since the heaters 72 of U.S. Pat. No. 3,596,028, around the lower U-bend gas storage region 33, are no longer usable, since the insulating support cone 31 is made non-perforate, it becomes necessary to heat the high-pressure gas 19 within the columns 8 by some other means. We prefer to heat the gas 19 within the collecting chambers 37 shown in FIG. 5. This collecting or heating chamber 37 is pneumatically connected to the column 8 by several ports 51, 53. The heating chamber 37 has several holes 51, 53 that communicate the gas 19 between the column 8 and the heating or convection chamber 37. These holes allow for natural convection to occur when the heat is applied to the heating chamber 37. The heaters 60, 61 (FIG. 12) are applied around the side and on the bottom 24 of the heating chamber 37, and the heat is transferred to the gas 19 through the walls of the chamber and through the curved heating fins 20 welded in place inside of the heating or collecting chamber 37. This warm gas then rises through the holes 51 to effectively heat the column 8, and the cold gas 19, that has lost its heat, then returns down through the holes 53 into the collecting or heating chamber 37, and again becomes warm. Thermal insulation 69 is supplied around the outside of this heating chamber 37 and the U-bend storage region 33, as shown in FIG. 12, to reduce the heat losses to the external atmospheric air. However, this insulation 69 cannot be attached around the upper portion of the column 8 adjacent the contacts 9, 17 due to voltage limitations. Therefore, the heat loss at this area cannot be reduced and the heat must be supplied to the column 8 to keep it warm. The reason that the column 8 must be kept warm is that the gas 19 (which may be $SF_6$, for example) will liquefy, and turn to a liquid at a temperature below 50°F. To maintain this minimum temperature, heat is therefore supplied into the heating and collecting chamber 37, and by natural convection circulated to the column 8 to maintain the gas temperature within the column structure 8 at about the aforesaid minimum 50°F. This heating arrangement, with the primary heater 59 supplied, maintains this temperature over all environmental conditions from a minus 40°F. up to, and above 50°F., which allows for wind effects and electrical current flow to pass through the breaker 1, and allows the column 8 to not overheat, that is, become hotter than 80°F. The column assemblage 8 is at a 20° angle, for example, as shown more clearly in FIG. 1. This places the high physical side 63 of the column 8 slightly physically higher than the low physical side 67 of the collecting chamber 37. Inasmuch as the gas 19 rises, when heated, the hot gas 19 from the higher side 63 of the heating chamber 37 moves up the high physical side of the column 8, and the cold gas 19, being cooler, goes down to the lower physical side 67 of the column 8, and the returns down to the bottom 67 of the low side of the heating chamber 37 through the return holes 53. This allows for natural convection of the gas 19 to occur uniformly and to continuously maintain a uniform heat distribution throughout the upstanding column structure 8.

The circuit-interrupter 1, described herein, is, for example, a 362 K.V. circuit-breaker capable of interrupting 40,000 amperes, and also capable of carrying 3,000 amperes continuously. This heater-control scheme 59 provides sufficient heat to permit the upstanding column 8 to operate properly down to an ambient temperature of -40°F. The high pressure at 70°F., within column structure 8, is 240 lbs. per square inch. The low pressue in the circuit-interrupter gas-system is normally at 5 lbs. per square inch. The insulation pressure normally is about 25 lbs. per square inch. The only gas 19, that needs to be heated, is the gas at high pressure, or at 240 p.s.i., for example. The low-pressure gases do not liquefy for temperatures down to a -40°F. The heat is supplied to this heating chamber 37 by the two banks of heaters 60 and 61. The primary bank of heaters is located around the outside of the collecting chamber 37, being designated by the reference numeral 60. This primary bank 60 is controlled by a probe (not shown) monitoring the actual gas temperature within region 55 of the collecting chamber 37. This always maintains the gas temperature within the collecting chamber 37 to 70°F.

The second, or secondary heating bank 61 is located beneath the bottom 24 of the heating, or collecting chamber 37, and constitutes, for example, separate kidney-shaped heater elements **61*a*, 61*b*. These heater elements 61*a*, 61*b* are turned on and off by the external ambient temperature, in that there is a known amount of heat that will be lost, under all conditions, to the external atmosphere for a given external ambient temperature of the outside atmosphere. The heat is then supplied at this minimum rate depending upon the primary heaters, 60 located around the outside 49 of this collecting cylinder 37 to make up the difference, such that the proper temperature of the gas 19** is always maintained.

The metallic heating fins 20 are welded to the bottom 24 of the heating or collecting chamber 37. They are welded to provide good thermal connection to the bottom 24 of the collecting or heating chamber 37, where the heaters **61*a*, 61*b* are also located. The metallic fins 20 supply additional surface area within the heating or collecting chamber 37 to transfer the heat to the gas 19 in region 55 to thus warm up the gas 19 within the collecting chamber 37. These fins 20 are located at, for example, a total circumferential angle of 270°, with only the lower physical portion 30 being vacant of these fins 20. The reason for the location of the fins 20 is that more heat is supplied to the high physical side 63 of the gas, at the higher side 63 of the column 8, such that it generates and assists the natural convection flow of gas. The heating chamber 37 and the internal fins 20** are all fabricated of aluminum.

Figure 10:
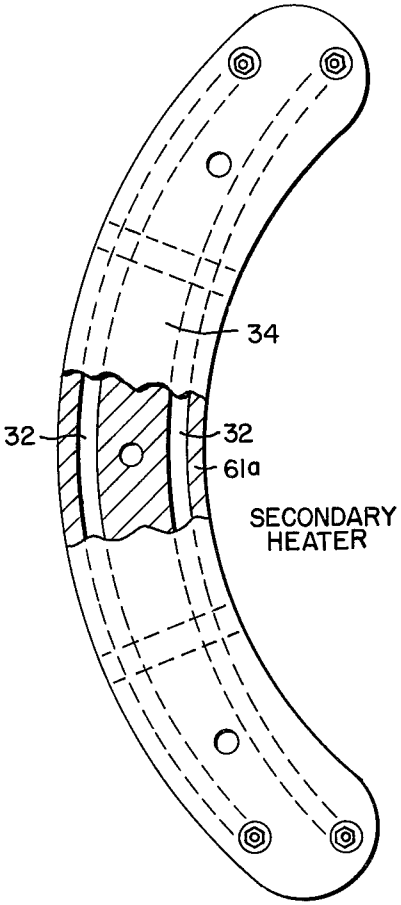
FIGS. 10 and 11 illustrate side-elevational views of the kidney-shaped secondary heating strips utilized adjacent the lower base portion of the collecting chamber for heating the gas.
Figure 11:
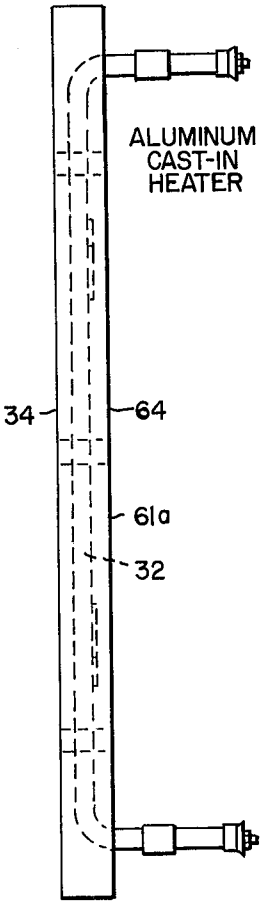

The heating chamber 37 is heated by the two kidney-shaped secondary heater elements **61*a*, 61*b* located at the bottom 24 of the collecting chamber 37. These kidney-shaped secondary heater elements 61*a*, 61*b* are fabricated in the following manner: An outside supplier makes two arc-shaped rod-pieces of heater elements, or strips 32, which are subsequently cast into this cast-aluminum heater-element 61*a* or 61*b*, more clearly set forth in FIGS. 10 and 11. These two arc, or kidney-shaped heater pieces 32 are first placed in a mold, and then hot aluminum metal is poured around these elements 32 and into the mold to effect a complete cast enclosure of these two heaters strip rods 61***a*, 61*b*. The bottom 34 of the cast kidney-shaped element 61*a*, or 61*b* is then machined off flat, such that an effective interface secondary heat transfer can then occur to the bottom 24 of the heating chamber 37 by the contiguous or abutting relationship, and thereby allow for minimal temperature-drop across the interface 24 between the cast-heater elements 61*a* and 61*b* and the lower surface 24 of the collecting chamber 37.

Figure 5:
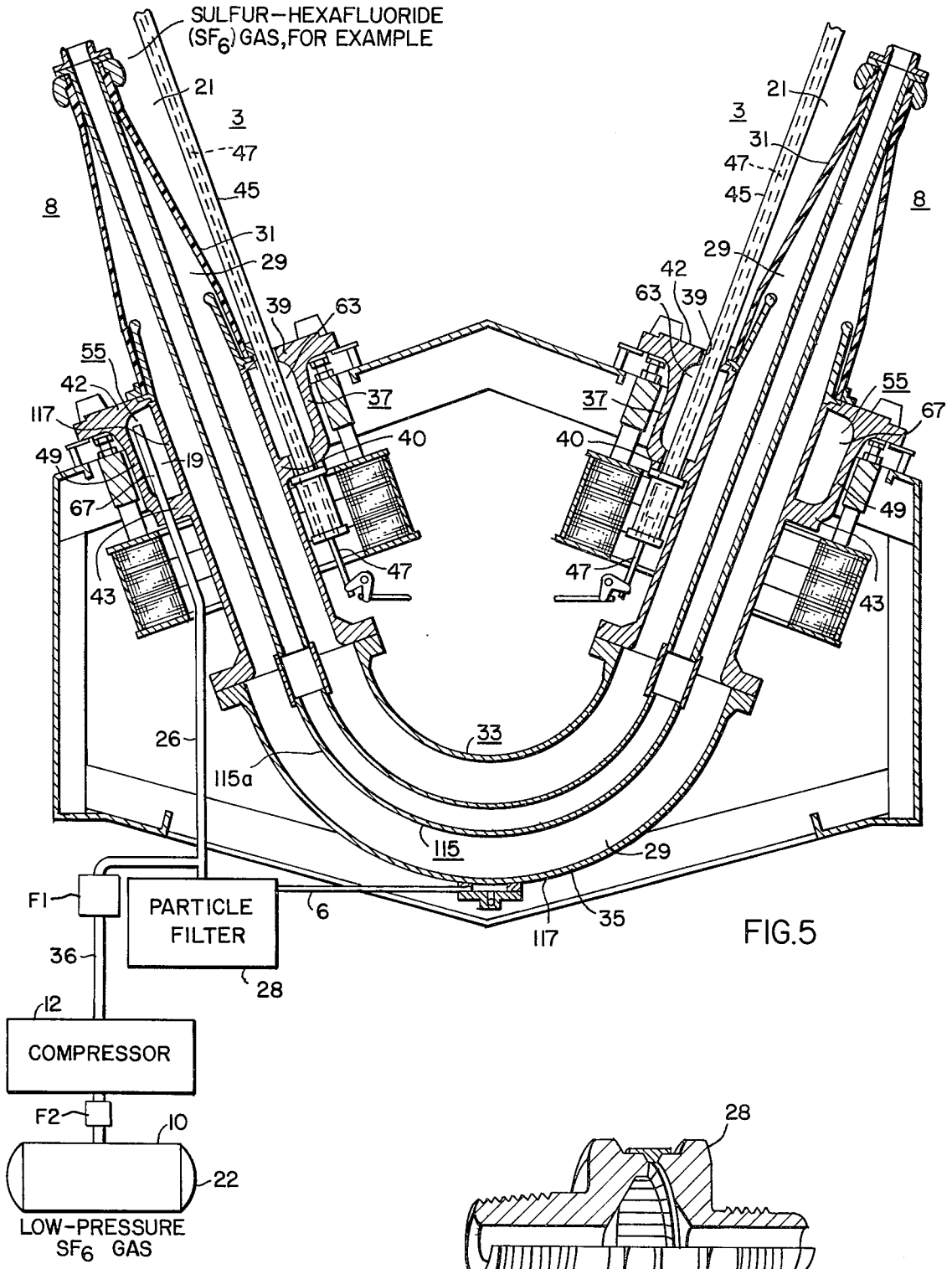
FIG. 5 is an enlarged sectional fragmentary view showing the unperforated support cones, the two grounded and collecting chambers of a circuit-breaker, where two interrupting assemblages are provided for the higher ratings, and the gas-pipe connections therefor.
Figure 5A:
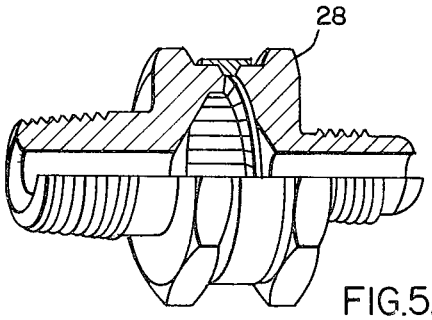
FIG. 5A is a perspective view, in one-quarter section, of the microporous filter element used in FIG. 5.
Figure 6:
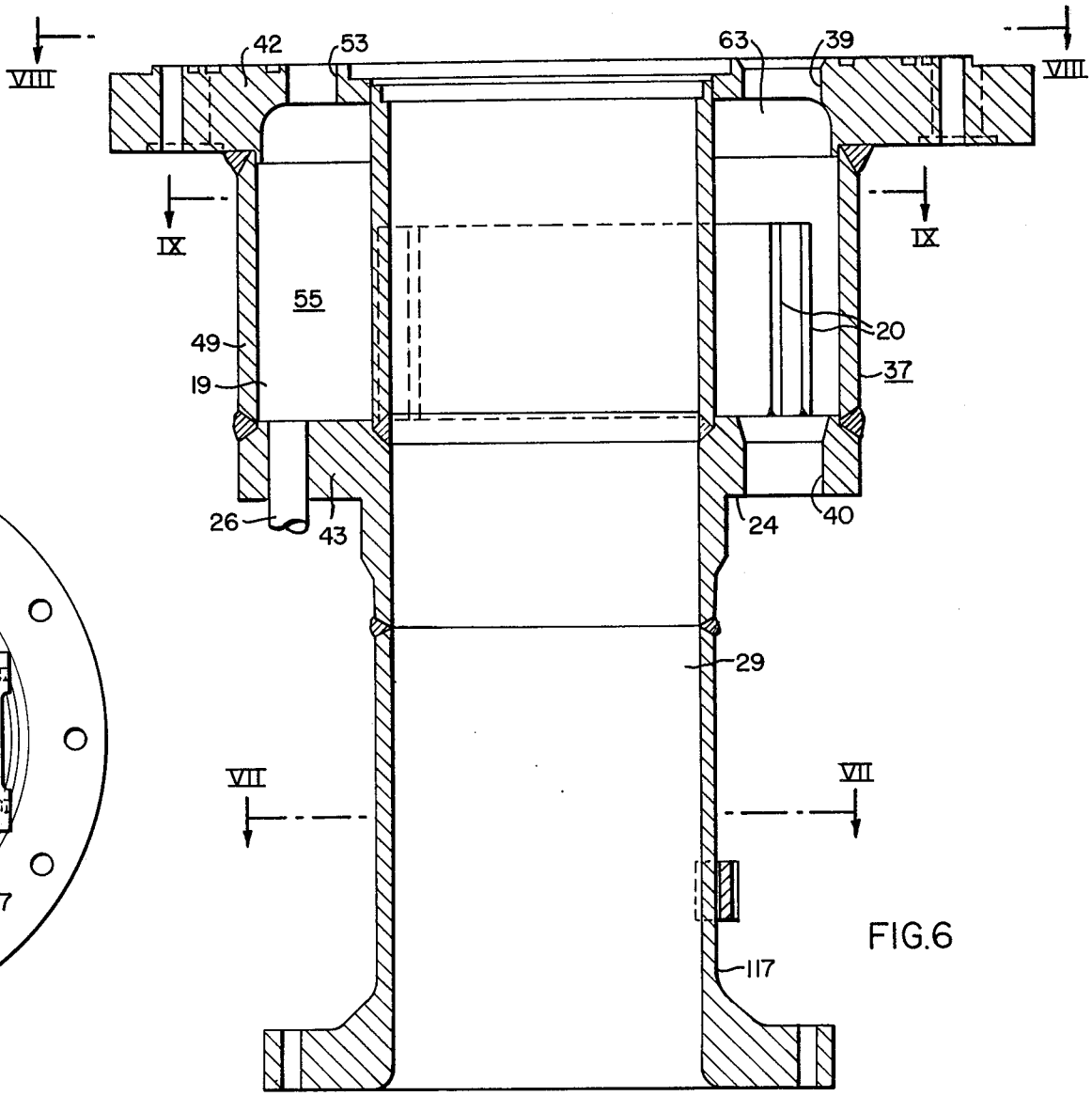
FIG. 6 is an enlarged vertical sectional view taken through one of the collecting chambers of FIG. 5.
Figure 7:
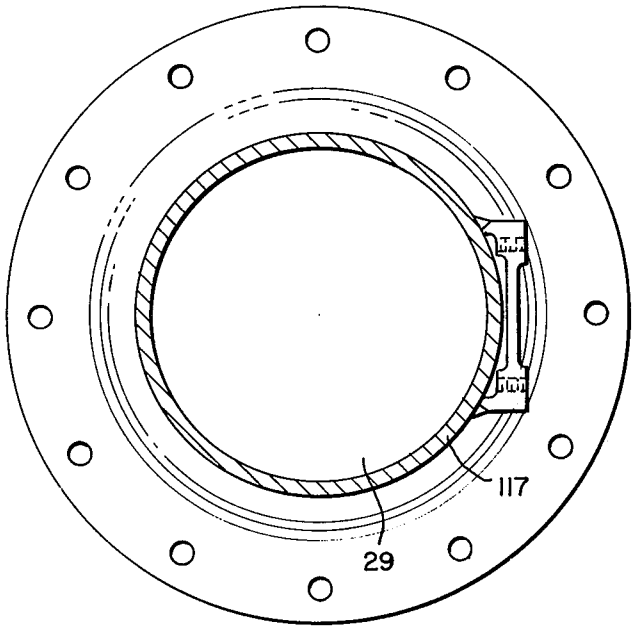
FIGS. 7, 8 and 9 are sectional views taken along the corresponding lines, indicated by the respective Roman numerals in FIG. 6, to further illustrate the heating and return apertures provided in the collecting chamber and the circular heating-fins provided therein.
Figure 8:
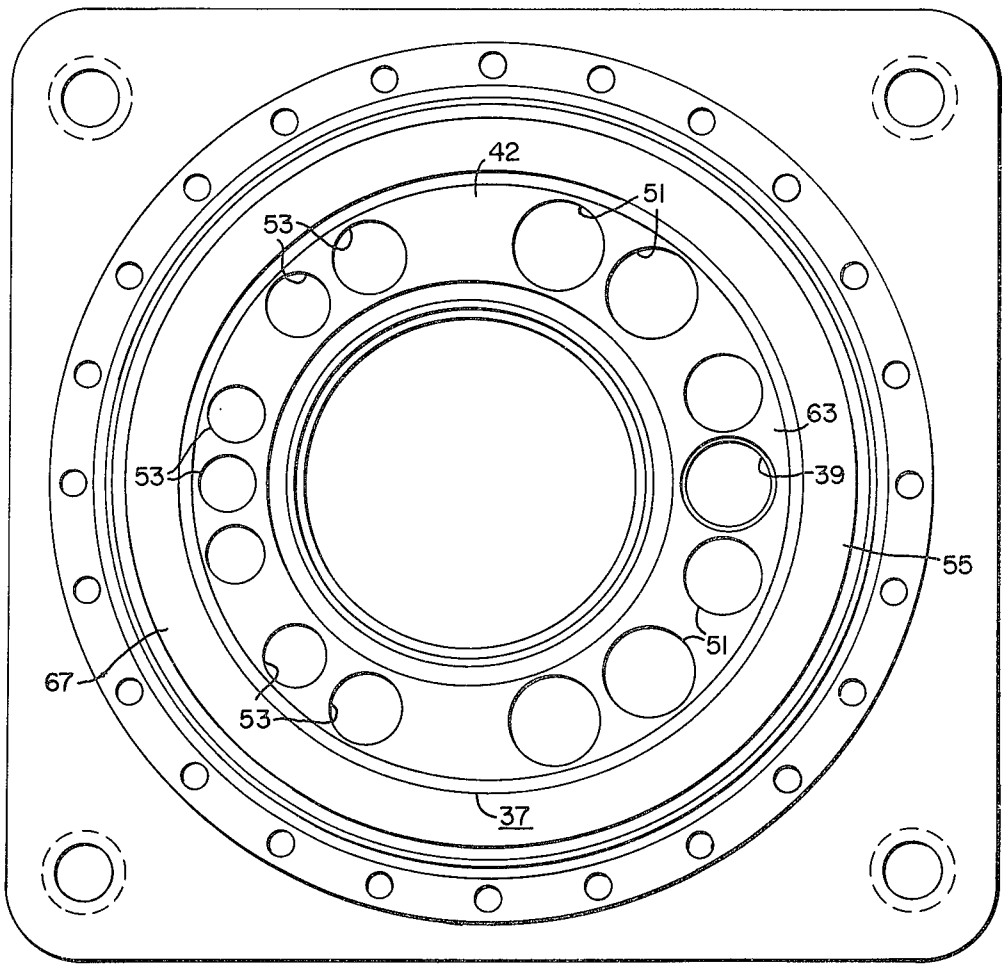
Figure 9:
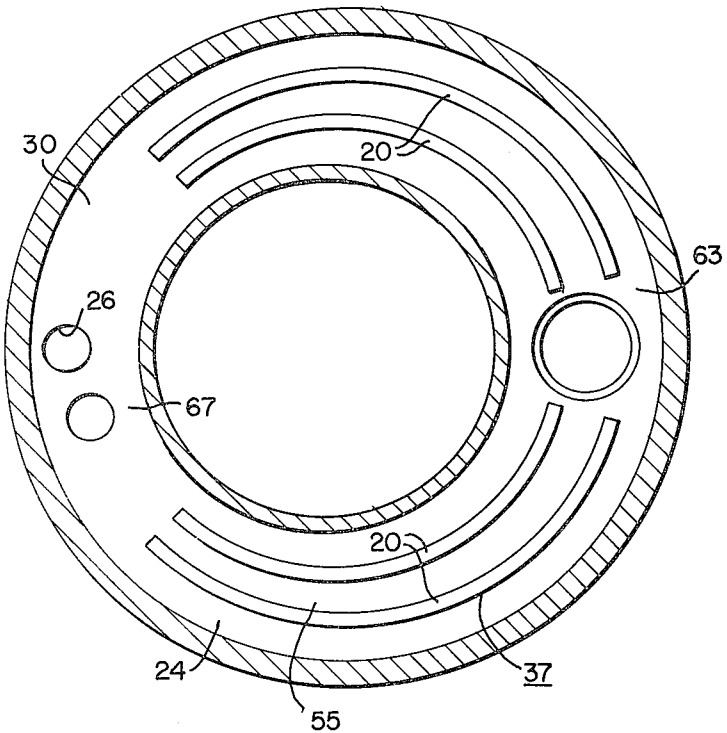

The present invention is particularly concerned with an improved means of compartmentalizing, or partitioning the high-pressure gaseous regions 21, 29 within the circuit-breaker structure 1, so that the interrupting region, herein designated as region 21, is separated or partitioned away from the high-pressure storage region, designated by the reference numeral 29 in FIGS. 1 and 4. To achieve this end, it will be noted that the insulating support cone 31, as partly illustrated in FIG. 4, and as more clearly illustrated in FIG. 5, is non-perforate, and provides a separate and independent high-pressure region 29 divorced from gaseous communication with the high-pressure region 21 adjacent the separable main contact structure 7. It is, of course, desirable to effect a gaseous pneumatic communication between the two regions 21 and 29. For this purpose, the collecting chamber, generally designated by the reference numeral 37, and then shown more clearly in FIGS. 6–9, is provided. It will be noted, with particular reference being directed to FIG. 6, that a pair of apertures 39, 40 are provided in upper and lower support plates 42, 43, through which an insulating operating tube 45 extends, and in the interior of which a reciprocally-operable valve-operating rod, designated by the reference numeral 47 in FIG. 5, is provided. As set forth in U.S. Pat. No. 3,596,028, this reciprocally-operable valve-operating rod 47 effects pneumatic operation of the high-voltage operator 15 disposed within the upper high-voltage operating dome region 13 of FIG. 1. Also, the collecting chamber 37, as constituted by the flange plates 42, 43 and the outer cylindrical portion 49, includes a plurality of holes 51, 53 affording gaseous intercommunication between the region 55 within the collecting chamber 37 and the upper high-pressure region 21 within the interrupting chamber 57 adjacent the contacts. This is more readily visualized by an inspection of FIGS. 5 and 6 of the drawings. It will be noted that there is provided pneumatic intercommunication between the high-voltage interrupting chamber 57 and the chamber 55 within the collecting chamber 37, as afforded by the openings or holes 51, 53 of FIGS. 8 and 9. In addition, suitable heating means 59, constituting the primary heating source 60 (FIG. 12), and the secondary heating source 61 (FIG. 12) are provided associated with the collecting chamber 37 to heat the gas 19, such as sulfur-hexafluoride ($SF_6$) gas, for example, and cause the hot gas 19 to flow upwardly by convection flow through the upper physical side 63 (FIG. 1) of the collecting chamber 37 within the upwardly-extending arc-extinguishing casing structure 65 (FIG. 1), and causing its return convection flow through the relatively small holes 53 provided at the lower end 67 (FIG. 1) of the collecting chamber 37.

Figure 13:
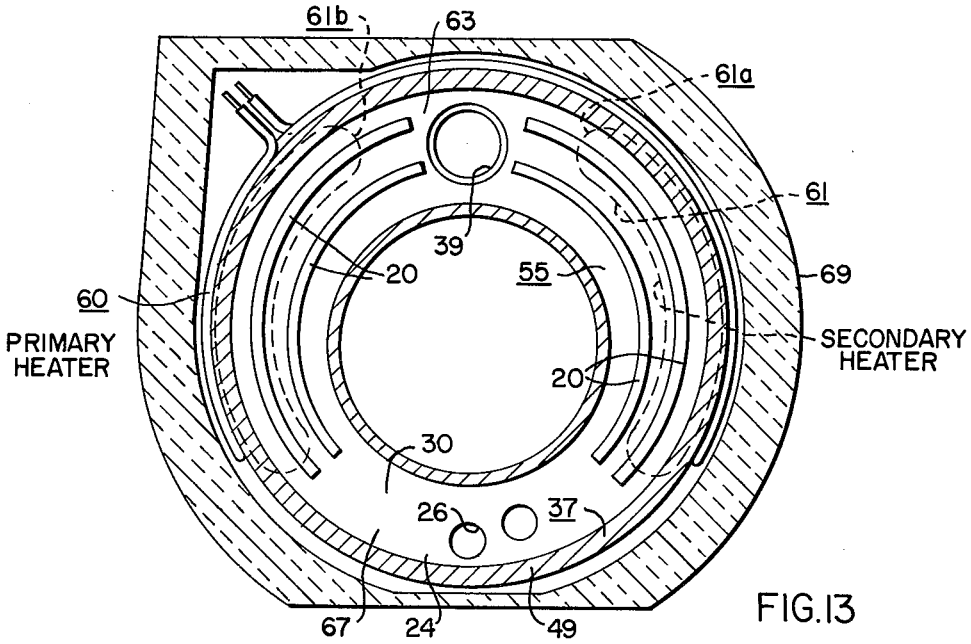
FIG. 13 is a sectional plan view of the collecting chamber of FIG. 12 taken along the line XIII—XIII of FIG. 12, illustrating the location of the kidney-shaped secondary heating strips constituting secondary heating means for heating the enclosed gas, and also showing the surrounding primary heating coils.

As illustrated in FIGS. 12 and 13, insulation material 69 surrounds both the primary an secondary heating strips 60, 61 so as to prevent the heat loss from the heating strips 60, 61 to the outside external ambient air or atmosphere, which may, conceivably, be at a low-ambient temperature condition, say 40° below 0°F., for example.

It is to be noted, however, that the primary heating source 60 is responsive to the actual gas temperature, as measured by a probe (not shown), which is inserted into the high-pressure gas region 55 within the collecting chamber 37. On the other hand, the secondary heating source 61, constituted, for example, by the pair of kidney-shaped cast heating strips 61*a*, 61*b*, is controlled by the outside ambient temperature conditions. Suitable means, well known by those skilled in the art, could provide such heating measurements and control, this is one responsive to the gas temperature within the collecting chamber 37, and a second temperature-responsive means measuring the external atmospheric air ambient temperature.

THEORY OF PARTICLE MOVEMENT

Figure 14:
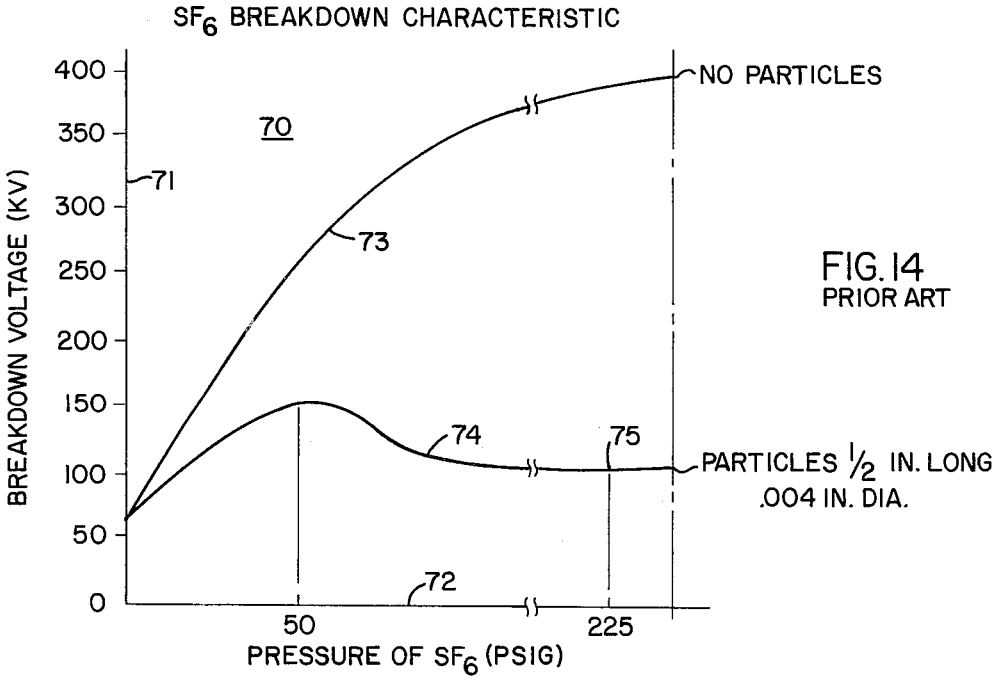
FIG. 14 PRIOR ART
FIG. 14 shows a breakdown characteristic curve for sulfur-hexafluoride ($SF_6$) gas.

Referring now to the drawings, and to FIG. 14 in particular, a sulfur-hexafluoride gas insulation breakdown characteristic 70 is depicted wherein alternating breakdown voltage in kilovolts (rms) is measured on the ordinate 71, and pressure in pounds per square inch gauge is measured on the abscissa 72. Plot or curve 73 shows the breakdown characteristics between two spaced electrodes for sulfur-hexafluoride insulating gas with virtually no particles immersed or present in it. On the other hand, plot or graph 74 shows the breakown characteristics between the same two spaced electrodes for sulfur-hexafluoride gas which has one-half inch long by 0.004 inch diameter cylindrical particles immersed in it. As can be seen by inspecting characteristics or graph 70, sulfur-hexafluoride insulating fluid with particles immersed in it breaks down at a relatively much lower voltage than the same gas without particles immersed in it. In the improved type of circuit-interrupter 1, as disclosed in FIGS. 1–4, sulfur-hexafluoride insulating fluid 19 is maintained at a pressure of approximately 225 lbs. per square inch gauge. At this pressure, the sulfur-hexafluoride gas 19 acts not only as an insulating medium for live, or high-voltage electrical components within the circuit-breaker 1, but also is employed in a blasting arrangement to assist in extinguishing an arc which occurs when the circuit-breaker or circuit-interrupter 14 is actuated to open an electrical current-carrying circuit 18. However, unless the sulfur-hexafluoride gas 19 is relatively particle-free, as is seldom the case, the breakdown voltage of the protected electrical insulated circuit-breaker is approximately 100 kilovolts at 225 lbs. per square inch gauge pressure. This is shown graphically at point 75 on curve 74 of breakdown characteristic 70 of FIG. 15. However, circuit-breakers employing sulfur-hexafluoride gas at this pressure are usually required to withstand a voltage of approximately 230 kilovolts or greater. Consequently, a contaminated sulfur-hexafluoride gas insulating medium maintained at a pressure of 225 lbs. per square inch will not provide adequate electrical insulation.

Figure 15:
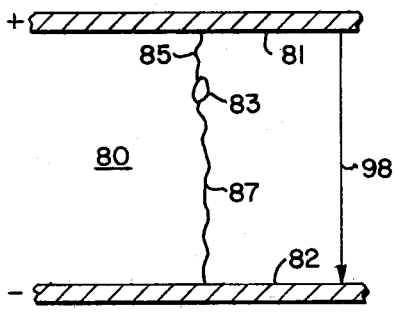
FIG.15 PRIOR ART
FIG. 15 shows a set of capacitor plates with an interposed particle to illustrate the principles of the present invention.
Figure 16:
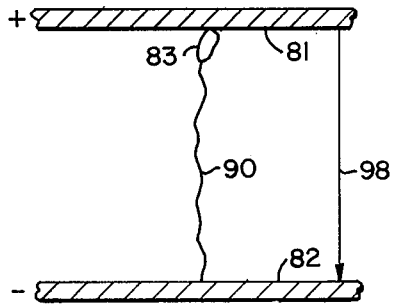
FIG.16 PRIOR ART
FIG. 16 shows a set of capacitor plates with an interposed particle.

The reason that the pressurized sulfur-hexafluoride gas insulating medium 19 with contaminating particles immersed in it does not properly insulate may be understood by referring to FIGS. 15 and 16. In FIG. 15, a parallel-plate capacitor arrangement 80 having a high-voltage capacitor plate or conductor 81 and a low-voltage capacitor plate or conductor 82 is shown. Interposed between plates 81 and 82 is a particle 83. Particle 83 may be dielectric or insulating or, alternatively, metallic in nature. In other words, it may be either an electrically insulating or an electrically conducting particle. In FIG. 15 particle 83 is shown in a position proximate or close or parallel plate or conductor 81, whereupon it is thought that a small electrical discharge may take place between the particle 83 and the conductor 81. The discharge 85 may cause an avalanche discharge 87 to continue from particle 83 to negative conductor or capacitor plate 82, thus causing a complete electrical breakdown between capacitor plates 81 and 82. This operation demonstrates the "trigatron" effect.

A second possible theory is demonstrated graphically in FIG. 16, wherein a similar parallel-plate capacitor arrangement is shown. A similar particle 82 is shown attached to, or abutting against plate 81. It is thought in this instance that the protrusion caused by particle 83 jutting or projecting from plate 81 creates a point where there is a relatively high concentration of potential stress, and from where a voltage breakdown, as indicated by jagged line 90, may easily occur. Regardless of which theory explains the breakdowns described, it is clear that the presence of particles 83, as shown in FIGS. 15 or 16, respectively, is a significant cause of electrical breakdown between conductors at different potentials.

Figure 17:
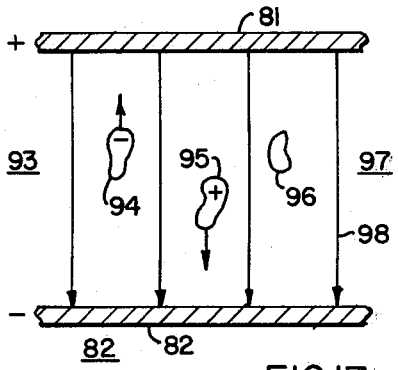
FIG.17 PRIOR ART
FIG. 17 shows a set of capacitor plates with interposed charged particles and electrical field lines; and, FIG. 18 shows a set of capacitor plates with a metallic grid particle trap to illustrate the principles of the present invention.

Referring now to FIG. 17, another parallel-plate capacitor arrangement 93 is shown having a positive electrically conducting plate 81 and negative electrically-conducting plate 82. Interposed between plates 81 and 82 is a plurality of particles 94, 95 and 96. Some particles, such as particle 96, have no charge and float randomly in insulating fluid 97. Other particles, such as particle 94, have a negative charge and are thus attracted to positively-charged capacitor plate or electrode 81, while a third type of particle, such as particle 95, has a positive charge, and is attracted to the negatively-charged capacitor plate 82. These charged particles 94 and 95 are accelerated due to the influence of an electrical field 98 between plates 81 and 82. As can be seen by reference to FIGS. 15 and 16, as the charged particles 94 and 95 in FIG. 17 migrate or move to the plates of the respective opposite polarities, the "trigatron" effect or the "abutting electrical particle" effect may occur causing a discharge or breakdown between plates 81 and 82. Of course, it may also be possible for the particles 94 and 95 to migrate to the respective plates of opposite polarity 81 and 82 and merely discharge without causing a breakdown between capacitor plates 81 and 82. In this case, the respective particles 94 and 95 will merely acquire the charge of the plates 81 and 82, respectively, to which they have migrated and begin to move towards the oppositely-charged plates 82 and 81 respectively. This phenomena could possibly continue independently, only occasionally causing a breakdown in the gaseous insulation 97, discussed previously.

Referring now to FIG. 18, a proposed well-known method for preventing voltage breakdowns, due to migrating charged particles, such as 99 and 100, is shown in the capacitor comination 101, which includes a pair of oppositely charged electrodes, or plates 81 and 82 and a metallic grid or screen 103, which is grounded or connected to one electrode 82 by a conductor 105. In this case, particles 99 and 100, corresponding to particles 94 and 95 in FIG. 17, migrate, as previously described. However, the electrical field, shown by lines 98, extends only to the metallic grid 103, since it is at the same potential or voltage level as plate or conductor 82. Consequently, any particle, such as particle 107, which has filtered through the grid or screen 103 finds itself in a zero electrical field, or field-free region 110, wherein no accelerating forces exist to cause the particles 107 to migrate or move to the oppositely-charged plate 81. U.S. Pat. No. 3,515,939 to J. G. Trump, issued June 2, 1970 explains more of the theory of the functioning of the metallic screen 103.

The filter element 28, illustrated in FIG. 5, is used to keep dirt and particles from reaching the U-bend gas storage area 35. The filter 28 is more clearly illustrated on an enlarged scale in FIG. 5A. The filter element 28 is supplied by the Circle Seal Products Company, Inc., located at Circle Seal Center, Post Office Box 366, Anaheim, California 92803. This company manufactures microporous in-line filters, being their 4200 series. The filter element 28 filters out contaminated particles as small as 2 microns (10 absolute). The filter element 28 may be easily cleaned by back-flushing with solvent, or other cleaning methods to readily restore the useful life of the filter 28. Precision manufacture of micronic wire-cloth insures a determinable maximum pore size. The element 28 is free from media migration. Continuous strands of high-strength stainless-steel wire in the filter element 28 cannot get loose and wash through the systems downstream of the filter.

Tests have indicated that particles as small as a 16th of an inch, when allowed to set on the inner high-voltage electrode 115 of FIG. 5, could, under some circumstances, cause flashover; and the dynamic characteristics of falling particles show that even particles smaller than this could cause flashover in this high-pressure chamber region 35. Thus, the main reason or motivation for providing a separating means and a collecting means 37 for the debris is not to allow it to get into the high-pressure gas storage chamber 29. The line-to-ground voltage between the inner high-voltage electrode 115 and the outer grounded electrode 117 for a 345 K.V. circuit-breaker, for example, would be 200 K.V. The highest voltage gradient occurs on the outer surface **115*a* of the inner electrode 115.**

The particles are created in the interrupter portion 14 of the breaker 1 by various means. One cause of their formation is during assembly operations at the factory during the bolting-together processes of the various parts; secondly, their formation is caused by interruption particles, such as conducting and insulating particles, created during the mechanical interruption of the breaker 1; thirdly, by just mechanical operation of the breaker, often embedded particles, aluminum filings, etc. are broken loose from the contacts, and thereby fall by natural gravity down to the bottom portion 33 of the breaker 1.

Prior to this invention, the circuit-breaker construction 1 employed a cast-epoxy cone 31 with large openings or apertures provided in the side wall of the cone 31, which were required in order to heat the gas within the breaker. Unfortunately, this allowed the falling debris to enter the resulting open high-pressure gaseous region 29 of the breaker, thereby sometimes causing electrical breakdown therein.

A communciating pipe 26 communicates the high-pressure gas 19 from the region 55 within the convection chamber 37 externally through piping 6 and through a filter 28 to the high-pressure gaseous region chamber 29 of the circuit-breaker 1. A compressor 12 (FIG. 5) compresses low-pressure gas 10 to a high pressure and supplies the high-pressure gas 19 through piping 36 to the region 21. The fitler 28 (FIG. 5A), which is a pleated, stainless steel filter element, has a filtration capability of 2 microns nominal, 15 microns absolute; thereby, the only communication between the insulating high-pressure chamber 29 and the interrupting high-pressure area 21 of the circuit-breaker 1 is through this filter 28. Thus, no particles larger than 15 microns can get into the high-pressure chamber 29 of the circuit-breaker.

The micronic filter 28 (FIG. 5A) does not permit any particle larger than 15 microns to pass through it into the high-pressure chamber region 33 of the circuit-breaker 1. One micron equals 1-1 millionth of an inch, or a thousand microns is equivalent of approximately 1 millimeter.

The grounded convection chamber 37 is provided in conjunction with the sealing non-perforated, insulating support cone 31, and it is a particle-collecting compartment, which is annular to the outer electrode 117 and open to the gas 21 in the interrupting area 7 above it. It serves two purposes—first, replacing the direct convection path which the unperforated cone 31 has now closed off, whereby heat may be applied to the particular gas 19 so that the temperature of the gas 19 in the interrupting area 21 can be maintained, and, secondly, it also provides a grounded collecting place where falling particles can settle undisturbed, shielded from electrostatic forces until such time as it is convenient to remove them. The heating function, as mentioned, is provided by the strip heaters 60, 61. This heating arrangement is utilized, for example, on the 345 K.V. type "SFV" circuit-breaker 1 for maintaining the $SF_6$ gas temperature above the condensation temperature. Heat is supplied to the convection chamber 37 via conduction through the metallic wall 49 by means of a circumferential primary strip-heater band assembly 60 of 1500 watts, for example, and secondly by cast-in secondary heater pads 61*a*, 61*b* of 2,000 watts, for example, which are attached to the base portion 24 of the chamber 37. This conduction is augmented by the additional surface area provided by circular 270° aluminum fins 20, which are welded internally to the base 24 of the chamber 37.

Heaters 60, 61 are disposed, preferably, only to the high physical side of the interrupter column 8, as shown in FIG. 1, such that a maximum heat flow is maintained across the diameter of the convection chamber 37, thereby permitting hot gas to flow up the column 8 on the high physical side of the canted column structure 8, and somewhat cooler gas to return to the chamber 37 along the low physical side 67 of the canted column 8, providing thereby natural convection circulation of the $SF_6$ gas 19. This construction was verified in the cold room tests on an interrupter column 8 with 3,500 watts of auxiliary heat via the strip heaters 60, 61 applied to the extinguishing column 8. The column gas temperature 19 in region 21 was uniformly maintained at +10°C. for an external ambient atmospheric condition of −40°C. The conduction efficiency of the cast-in secondary heaters 61*a*, 61*b* was also verified by tests showing only a 14°C. drop between external wall temperature and the internal gas temperature with 1 kilowatt of heat applied.

From the foregoing description it will be apparent that there has been provided an improved particle-trapping construction for a dual-pressure high-voltage circuit-interrupter 1 in which the high-pressure region 21 adjacent the separable contact structure 7 is separated, or compartmentalized from the high-pressure storage chamber 35, so that small insulating or metallic particles 83, 94, 95, 96, etc. may not wander from the separable contact area 21 down into the high-pressure U-bend gas storage region 29 to precipitate voltage breakdown therein, that is, between the inner conductor 115 at high-voltage and the outer grounded conductor 117. Also, it will be observed that there has been provided a particle collecting chamber 37, which is at ground potential and provides an electrostatic field-free space 55 within the collecting chamber 37 to trap therein small particles 83, 94, 95, 96 etc. and render them inactive and unsusceptible to influence by electrostatic fields 98. The theory, set forth in Trump U.S. Pat. No. 3,515,939, is again pertinent in this connection.

Although there has been illustrated and described a specific structure, it is to be clearly understood that the same was merely for the purpose of illustration, and that changes and modifications may readily be made therein by those skilled in the art, without departing from the spirit and scope of the invention.

I claim:

1. A high-voltage circuit-interrupter of the gas-blast type including separable contact means separable to establish an arc, blast-valve means for causing a blast of gas to flow against the arc to effect the extinction thereof, operating means to effect the separation of said separable contact means, an elongated high-voltage conductor leading to one of the separable contacts, an annular grounded metallic collector chamber (37) of relatively short length surrounding said high-voltage conductor yet spaced outwardly therefrom, conduit means providing gas-communication between said annular grounded relatively-short metallic collector chamber (37) and the gaseous region adjacent said separable contact structure, heating means associated with said grounded metallic collector chamber of relatively short length to heat the gas therein, and means for feeding high-pressure gas directly into said metallic collector chamber.

2. The combination of claim 1, wherein the heating means includes an encircling heating coil encompassing said annular grounded metallic collector chamber.

3. The combination according to claim 2, wherein a secondary heating means is provided to heat the bottom of said collector chamber.

4. The combination according to claim 1, wherein one or more metallic fins are affixed to the bottom of the annular grounded metallic collector chamber to assist in heating the gas provided therein.

5. The combination according to claim 1, wherein the annular grounded metallic collector chamber is canted, and the heating means is somewhat concentrated on the high physical side (63) of the annular grounded metallic collector chamber.

6. The combination according to claim 1, wherein the conduit means includes apertures (51) on the high physical side (63) of the collector chamber which are larger than the apertures provided on the low physical side of the collector chamber for taking advantage of normal convection currents.

7. The combination according to claim 1, wherein the heating means includes a secondary heating means responsive to the ambient temperature surrounding the circuit-breaker.

8. The combination according to claim 7, wherein the heating means includes additionally a primary heating means responsive to a prove measuring the temperature of the gas contained within the collector chamber.

9. The combination in a high-voltage compressed-gas circuit-interrupter of an upstanding columnar arc-extinguishing assemblage, casing means associated with said columnar arc-extinguishing assemblage including a pair of separable contact means separable to establish an arc, blast-valve means for causing a blast of gas to flow against the arc when established to effect the extinction thereof, operating means to effect the separation of said separable contact means, a high-voltage conductor at least a portion of which is generally upstanding leading to one of the separable contacts, an annular grounded metallic collector chamber (37) of relatively short length surrounding said high-voltage conductor yet spaced outwardly therefrom, gas-communicating means provided between the region adjacent said separable contacts and the interior of said relatively short collector chamber, heating means associated with said collector chambers to heat the gas provided therein, and means for feeding high-pressure gas directly into said metallic collector chamber.

10. The combination according to claim 9, wherein the arc-extinguishing assemblage is canted, and apertures are provided on the high physical side of the collector chamber which are larger than the apertues provided on the low physical side of the collector chamber.

11. The combination according to claim 9, wherein the heating means comprises a secondary heating coil encircling the collector chamber and responsive to the ambient temperature, and a primary heating means is associated with the bottom of said collector chamber and is responsive to the temperature of the gas provided within said collector chamber.

12. The combination according to claim 11, wherein the secondary heating means comprises one or more heater pads provided in contiguous relationship with the bottom of the collector chamber.

13. The combination according to claim 9, wherein surface heating fins are provided and are circular and are provided only on a partial circumferential disposition on the high physical side of the collector chamber.

14. The combination according to claim 10, wherein the heaters are provided only on the high side of the interrupter column to encourage the hot gas to flow up the high side of the column and to permit the cooler gas to return to the collector chamber along the low physical side of the column to encourage natural convection circulation of the gas.

15. A high-voltage circuit-interrupter of the gas-blast type including separable contact means separable to establish an arc, blast-valve means for causing a blast of high-pressure gas to flow against said arc to effect the extinction thereof, operating means to effect the separation of said separable contact means and also to effect blast-valve operation, an elongated high-voltage metallic conductor leading to one of said separable contacts, a surrounding grounded metallic tubular member surrounding said elongated high-voltage conductor and forming an annular space therearound, said annular space constituting a high-pressure gas-reservoir chamber (29), an outwardly-extending relatively-short metallic annular grounded container-chamber having its inner metallic wall constituting a portion of the wall of said previously-mentioned grounded tubular surrounding member, said metallic container-chamber having a lower closure portion and an upper closure portion, means for feeding high-pressure gas into said lower closure portion by a high-pressure feed pipe which extends into said annular metallic container-chamber an appreciable extent therewithin to avoid particle contamination by aspiration into the gas, said upper closure portion of said annular metallic container-chamber having at least a pair of apertures provided therein, pneumatic gaseous communication means provided between said apertures disposed at said upper closure portion of said metallic annular container-chamber and the region around said separable contacts, and gas-heating means associated with said annular metallic container chamber to heat the high-pressure gas therein to prevent the liquification thereof.

16. The combination according to claim 15, wherein said heating means comprises a first primary heating means (60) responsive only to the actual temperature of the high-pressure gas disposed within said container-chamber, and said heating means additionally comprising a secondary heating means (61) responsive only to the surrounding ambient temperature externally of the circuit-interrupter.

17. The combination according to claim 16, wherein the primary heating means at least partially encircles the vertical sides of said container-chamber, and said secondary heating means comprises one or more heating elements abutting the lower closure member of said annular metallic container-chamber.

18. The combination according to claim 15, wherein the container-chamber includes a plurality of upstanding metallic fins affixed in heat-transfer relationship to said lower closure portion of the container-chamber to facilitate heat transfer to the contained high-pressure gas by convection.

19. The combination according to claim 15, wherein an upstanding insulating casing structure is provided enclosing the separable contacts and contains high-pressure gas therein at an elevated pressure about said separable contacts.

20. The combination according to claim 15, wherein the separable contacts constitute a primary valve means so that when the separable contacts are separated, the high-pressure gas will flow radially inwardly into at least one of said separable contacts for arc-extinction purposes.

21. The combination according to claim 18, wherein the high-voltage inner conductor, the outer surrounding metallic grounded elongated tubular member and the annular container-chamber are canted, and the metallic heat-transfer fins (20) are disposed on the high physical side (63) of the container-chamber for facilitated gas-covection flow.

22. The combination according to claim 15, wherein a particle filter is provided, an pneumatic gas-flow means interconnects the annular high-pressure gas-storage region surrounding the inner high-voltage conductor through said particle filter to said high-pressure feed pipe extending into the container-chamber.

23. A high-voltage compresses-gas circuit-interrupter including separable contact means separable to establish an arc, blast-valve means for causing a blast of high-pressure gas to flow against the established arc to effect the extinction thereof, operating means to effect the separation of said separable contact means and also to effect blast-valve operation, means defining a high-pressure gas-reservoir chamber, and heating means for said high-pressure gas-reservoir chamber comprising a first primary heating means (60) responsive only to the actual temperature of the high-pressure gas disposed within said high-pressure gas reservoir, chamber, and said heating means additionally comprising a secondary heating means (61) responsive only to the surrounding ambient temperature externally of the circuit-interrupter structure.

* * * * *